United States Patent [19]

Ross

[11] 4,306,948

[45] Dec. 22, 1981

[54] LIMITING PRODUCTION OF AN ELECTROLYTIC ALKALI METAL CELL

[75] Inventor: Francis J. Ross, Niagara Falls, N.Y.

[73] Assignee: E. I. Du Pont de Nemours & Co., Wilmington, Del.

[21] Appl. No.: 215,451

[22] Filed: Dec. 11, 1980

[51] Int. Cl.[3] ..... C25C 3/02

[52] U.S. Cl. ..... 204/68

[58] Field of Search ..... 204/68

[56] References Cited

U.S. PATENT DOCUMENTS 4,139,428 2/1979 Dean et al. ..... 204/68

*Primary Examiner*—Howard S. Williams

[57] ABSTRACT

The production of an electrolytic alkali-metal cell can be temporarily curtailed by adding sodium-, calcium- or barium sulfate to the cell and reducing the current flow.

3 Claims, No Drawings

LIMITING PRODUCTION OF AN ELECTROLYTIC ALKALI METAL CELL

DESCRIPTION

1. Technical Field

This invention relates to an improvement in the process of producing alkali metals, especially sodium, by electrolysis of a fused salt bath. It is more particularly directed to the improvement whereby the production of an electrolytic alkali metal cell can be temporarily curtailed by adding to it a controlled amount of sodium-, calcium- or barium sulfate.

2. Background and Summary of the Invention

Alkali metals are ordinarily produced by electrolysis of a fused salt bath in a cell of the type described by Downs in his U.S. Pat. No. 1,501,756. Ordinarily, such a cell is, for obvious economic reasons, operated continuously and at maximum production levels. Occasionally however, because of raw material or power shortages, overproduction or the like, it becomes necessary to limit its production.

To the uninitiated, it might seem that the best way to do this would be to simply shut the cell down until conditions permit or require that production resume. This, however, is not a practical solution because when the flow of electric current to the cell is stopped, resistance-heating of the bath also stops and the molten salt bath quickly cools and solidifies. Before alkali metal production in the cell can resume it must be rebuilt, a time-consuming an expensive operation.

It's true that the alkali metal production of a cell can be somewhat curtailed, not by stopping the current flow to the cell entirely, but by reducing it. But production cannot be curtailed by more than about 5% over an extended period by this procedure because if current flow is too greatly restricted, resistance heating also declines to the point at which the salt bath gradually cools and begins to solidify.

U.S. Pat. No. 4,129,428 teaches that production of an alkali metal cell can be curtailed by adding aluminum oxide or magnesium oxide to the salt bath. When such a modified bath is used, the electrolytic action of the cell deposits aluminum or magnesium between the cell diaphragm and the cathode, thereby short-circuiting the cell and decreasing its production. Before production can resume, this aluminum or magnesium must be removed by shaking the diaphragm so that the metal falls to the bottom of the cell, or by replacing the diaphragm entirely. Either alternative requires time and effort.

It is clear from the foregoing that there is a real need for a simple, effective and inexpensive method for curtailing production of an electrolytic alkali metal cell. This need is filled by the present invention, according to which sodium-, calcium- or barium sulfate is added to the fused salt bath. This permits the current flow to the cell to be reduced to the point at which alkali metal production is curtailed by as much as 50%, but without the salt bath solidifying.

The process of the invention is especially suited for use in an electrolytic sodium cell.

DETAILED DESCRIPTION OF THE INVENTION

The types of electrolytic cells which can be used in practicing the invention, and the various types of fused salt baths which can be used in them to produce alkali metals, are described in U.S. Pat. No. 4,139,428, which is incorporated into this description to show those things.

The sodium-, calcium- or barium sulfate used in the process of the invention can be any of those available in the marketplace. No special grade or purity is required, but the presence of water in the sulfate is to be avoided because, as is well-known, it reacts with sodium to form hydrogen, which in turn can form explsoive mixtures with air. It is therefore recommended that the sulfate be anhydrous. Sodium sulfate is preferred.

The concentration of sulfate in the fused salt bath is important. If too little is present, the bath solidifies when current flow is reduced to the desired lower level. If too much is present, production of alkali metal stops altogether. The object is to keep the temperature of the salt bath at 585°–625° C., and this is done by keeping the amount of sulfate added and the current reduction in proper balance. Generally, the concentration of sulfate in the electrolytic zone is maintained in the range 20–40 ppm, preferably about 30 ppm (as determined by periodic sampling and analysis for sulfate ion by titration) for so long as production is curtailed. "Electrolytic zone" is that zone within the cell in which electrolysis actually occurs.

Production curtailment is begun, after addition of an appropriate amount of sulfate to the bath, by gradually reducing the flow of current to the cell until a bath temperature of 585°–625° C. is reached. This temperature is maintained during the period of curtailment by replenishing the sulfate as needed and by adjusting the current flow.

The cell can be brought back to full production by simply making no further sulfate additions and then gradually bringing the current flow back normal. About 16–24 hours after the last sulfate addition, the cell will have purged itself of sulfate. Current flow can then be gradually increased until the proper level is reached. Normal alkali metal production then resumes, with no harm to the equipment or to the fused salt bath.

Production can be thus curtailed indefininitely, but as a practical matter the period of curtailment will seldom exceed three or four days.

BEST MODE 0.9 Kg (2 pounds) of sodium sulfate was added every 8 hours for 24 hours to an 8200 kg (18,000 pound) bath in a conventional Downs cell. During this period, the current flow to the cell was gradually reduced from 45,000 amperes to 35,000 amperes. This kept the bath temperature at 585°–625° C. during the period.

Sixteen hours after the last addition of sulfate, the bath temperature began to fall, and the current flow was gradually increased. About 30 hours after the last addition of sulfate, current flow was again 45,000 amperes, and operation of the cell was normal, with no evident aftereffects.

During the 46 hour curtailment, production of the cell was reduced by about 45%.

I claim:

1. In the production of alkali metal from a fused salt bath in an electrolytic cell, a method of temporarily curtailing production which comprises maintaining in the electrolytic zone of the bath 20–40 ppm of sodium-, calcium- or barium sulfate, while simultaneously altering the flow of electric current to the cell, so as to maintain the salt bath at a temperature of 585°–625° C.

2. The method of claim 1 in which the sulfate is sodium sulfate.

3. The method of claim 1 wherein the alkali metal produced is sodium and the sulfate used is sodium sulfate.

* * * * *